US007630670B2

(12) United States Patent
Nishihama et al.

(10) Patent No.: US 7,630,670 B2
(45) Date of Patent: Dec. 8, 2009

(54) DEVELOPING APPARATUS AND IMAGE FORMING APPARATUS

(75) Inventors: Tadayoshi Nishihama, Abiko (JP); Fumitake Hirobe, Ushiku (JP); Akihiro Noguchi, Toride (JP); Akinori Tanaka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 589 days.

(21) Appl. No.: 11/439,982

(22) Filed: May 25, 2006

(65) Prior Publication Data

US 2007/0053720 A1 Mar. 8, 2007

(30) Foreign Application Priority Data

Sep. 8, 2005 (JP) ..... 2005-261393

(51) Int. Cl.
*G03G 15/08* (2006.01)

(52) U.S. Cl. ..... 399/227; 399/119; 399/111; 399/260; 399/258

(58) Field of Classification Search ..... 399/227, 399/260
See application file for complete search history.

(56) References Cited

U.S. PATENT DOCUMENTS 4,622,916 A * 11/1986 Tanaka et al. ..... 118/688
6,975,825 B2 12/2005 Sakamaki et al.
7,509,080 B2 * 3/2009 Iwata et al. ..... 399/258
2004/0086301 A1 * 5/2004 Tamura ..... 399/227
2004/0265010 A1 * 12/2004 Otani ..... 399/258
2005/0180782 A1 * 8/2005 Matsumoto et al. ..... 399/262
2006/0083554 A1 4/2006 Nishihama et al.
2006/0088341 A1 4/2006 Noguchi et al.
2006/0204281 A1 * 9/2006 Wada et al. ..... 399/227
2007/0059043 A1 3/2007 Tanaka
2007/0183813 A1 * 8/2007 Iwata et al. ..... 399/227

FOREIGN PATENT DOCUMENTS

JP 59-100471 A 6/1984
JP 2-21591 B2 5/1990

* cited by examiner

*Primary Examiner*—David M Gray
*Assistant Examiner*—Roy Yi
(74) *Attorney, Agent, or Firm*—Fitzpatrick, Cella, Harper & Scinto

(57) ABSTRACT

In a developing apparatus provided with a developer container containing a developer, a rotary member holding the developer container and rotatively moving it relative to a developing position, an opening portion provided in the developer container and through which the developer is supplied or discharged, a valve swingable to open and close the opening portion, and a restricting wall restricting the movement of the valve in an opening direction by contacting with the valve when the valve is in an opened position, an irregularity portion is provided on at least one of the contact surface of the valve with the restricting wall and the contact surface of the restricting wall with the valve.

8 Claims, 7 Drawing Sheets

20
A
4
3
3a
5
8
6
7
1
2
53
9
50
40
2A

52a(52b)
2
50a(50b)
53a(53b)
51a(51b)
55a(55b)
40a(40b)
13
12
56a(56b)

DEVELOPING APPARATUS AND IMAGE FORMING APPARATUS

BACKGROUND OF THE INVENTION

1. Field of the Invention

The invention relates to a developing apparatus for developing an electrostatic image formed on an image bearing member by an electrophotographic printing method or an electrostatic recording method, and particularly to a developing apparatus provided with a valve for the supply and discharge of a developer.

2. Related Background Art

In image forming apparatuses, and above all, a color image forming apparatus of an electrophotographic printing type which performs color image formation, there has heretofore been widely utilized a dual-component developing method using a mixture of a toner and a carrier as a developer.

On the other hand, in a full-color copying machine, printer or the like available in recent years, the introduction of the following technique has been advanced as a method of maintaining a high quality of image without performing the work of interchanging a developer.

For example, Japanese Patent Publication No. JP-B-H02-021591 discloses an image forming apparatus in which a carrier supplying device and a toner supplying device are provided separately from or integrally with each other above agitating means for agitating a carrier and a toner. In this image forming apparatus, there is adopted a construction in which a developer spillover portion is provided in a side wall of the housing of a developing apparatus and a fresh developer is supplied little by little by a supplying device and is discharged from the developer spillover portion.

That is, in the image forming apparatus of the above-described construction, a deteriorated carrier in the developer is gradually replaced with a fresh one, whereby the apparent progress of the deterioration of the carrier is stopped, and a characteristic is stabilized as the whole of the developer. Thereby, the work of interchanging the developer is made unnecessary and a maintenance property is improved.

As described above, in a developing apparatus which has taken long-term image stability into account, it is popular to provide a developer supplying port and a developer spillover portion (hereinafter referred to as the "developer discharging port").

However, an inconvenience arises in a so-called rotary developing apparatus wherein such a developing apparatus is provided in a system, for example, a developing rotary in which the developing apparatus itself is moved, for example, is rotatably carried.

That is, at the other positions than a position at which the developing apparatus is opposed to a photosensitive member, and the developing apparatus is maintained in a substantially horizontal position, there is the possibility that the developer may inadvertently leak out from the above-mentioned supplying port and discharging port. In such a case, the developer in the developing apparatus greatly diminishes with a result that developer coat uniformity on an image bearing member is spoiled or no coat is applied at all. Accordingly, there arises the inconvenience that density uniformity becomes faulty or no density is provided at all.

Therefore, it is conceivable to provide a valve in the developer supplying port or the discharging port, to prevent the developer from inadvertently leaking out from the supplying port or the discharging port with the exception that the developing apparatus is in a substantially horizontal position, and to control the supply and discharge of the developer.

The above-mentioned valve, however, is located at a position where it is liable to be stained with the developer and therefore, the operation thereof has often become unstable. Particularly, in a low-humidity environment, the discharging amount of the toner per unit mass increases. Therefore, it becomes difficult to remove the toner adhering to a stopper wall for regulating the operation range of the valve by a Coulomb force. In a state in which such a toner is sandwiched between the stopper wall and the valve for a long period, there has been the possibility that the toner may adhere the valve to the stopper wall in the fashion of a binder to thereby hamper the function of the valve.

SUMMARY OF THE INVENTION

So, it is the object of the present invention to provide a developing apparatus which smoothes the movement of a valve provided in an opening portion for effecting the supply or discharge of a developer, and can ensure the supply and discharge of the developer to be effected.

In order to achieve the above object, a developing apparatus for developing an electrostatic image on an image bearing member at a developing position has:

a developer container, which contains a developer;

a rotary member, which holds the developer container, and rotatively moves the developer container relative to the developing position;

an opening portion provided in the developer container and through which the developer is supplied or discharged;

a swingable valve to open and close the opening portion, the valve being located in an opened position when the developer container is at the developing position; and a restricting wall, which restricts the movement of the valve in its opening direction by contacting with the valve when the valve is in the opened position, wherein an irregularity portion is provided on at least one of the contact surface of the valve with the regulating wall and the contact surface of the restricting wall with the valve.

DESCRIPTION OF THE PREFERRED EMBODIMENTS

A developing apparatus and an image forming apparatus according to the present invention will hereinafter be described in greater detail with reference to the drawings.

First Embodiment

Figure 1:
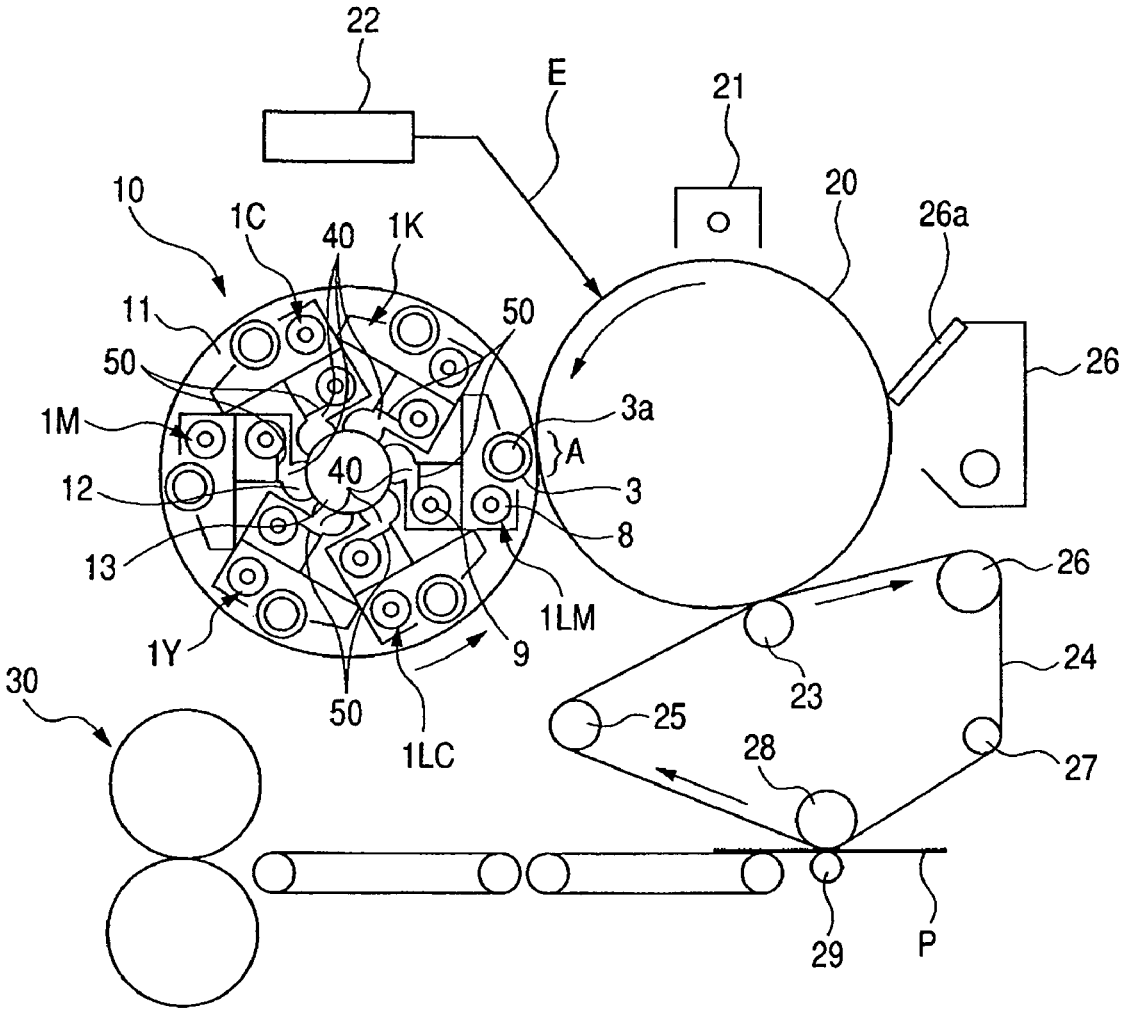
FIG. 1 is a cross-sectional view schematically showing the construction of an embodiment of the image forming apparatus of the present invention.

FIG. 1 schematically shows the construction of a color image forming apparatus of an electrophotographic printing type which is an embodiment of the image forming apparatus according to the present invention. Also, according to the present embodiment, the color image forming apparatus is provided with a rotary developing apparatus.

Description A description will first be made of the general construction and operation of the image forming apparatus.

In the present embodiment as shown in FIG. 1, the rotary developing apparatus 10 is disposed in opposed relationship with a drum-shaped electrophotographic photosensitive member (hereinafter referred to as the "photosensitive drum") 20 journalled for rotation in the direction indicated by the arrow.

The rotary developing apparatus 10 is provided with a rotatably carried rotary member, i.e., a developing rotary 11, and a plurality of developing apparatuses 1 are carried on the developing rotary 11. In the present embodiment, there are carried developing apparatuses 1LM, 1LC, 1Y, 1M, 1C and 1K of six colors, i.e., LM (light-colored magenta), LC (light-colored cyan), Y (yellow), M (dark-colored magenta), C (dark-colored cyan) and K (black). The developing apparatuses 1LM (light-colored magenta), 1LC (light-colored cyan), 1Y (yellow), 1M (dark-colored magenta), 1C (dark-colored cyan) and 1K (black) are of the same construction, and only differ in the colors of developers contained therein from one another.

Also, around the photosensitive drum 20, there are disposed a charger 21 as primary charging means, an intermediate transfer belt 24 as an intermediate transfer member, and a cleaning device 26 as cleaning means. The intermediate transfer belt 24 is stretched over a plurality of supporting rollers 25, 26, 27 and 28, and is rotatively moved in the direction indicated by the arrow.

First, the surface of the photosensitive drum 20 is uniformly charged by the charger 21. The charged surface of the photosensitive drum 20 is exposed to a laser beam E from a laser scanner device 22 as exposing means, whereby an electrostatic latent image is formed on the photosensitive drum 20.

In order to develop this electrostatic latent image, the rotary developing apparatus 10 rotates the developing rotary 11 in the direction indicated by the arrow, and moves predetermined one of the developing apparatuses 1LM, 1LC, 1Y, 1M, 1C and 1K to a developing portion opposed to the photosensitive drum 20. In the developing portion, each developing apparatus 1 is in a substantially horizontal position.

The developing apparatus 1 being in the substantially horizontal position is operated to thereby develop the electrostatic latent image on the photosensitive drum 20, thereby forming a visible image, i.e., a toner image on the photosensitive drum 20.

This toner image formed on the photosensitive drum 20 is sequentially transferred onto the intermediate transfer belt 24 by a transfer bias by a primary transfer roller 23 which is primary transferring means and thus, the toner images of the respective colors are superposed one upon another. As the result, the respective toner images are successively superposed on the intermediate transfer belt 24, whereby a full-color toner image is formed thereon.

The toner image of the six colors formed on the intermediate transfer belt 24 is transferred to recording paper P by a transfer roller 29 as secondary transferring means, whereafter it is pressurized and heated by a fixing device 30 to thereby obtain a permanent image. Also, any residual toner residual on the photosensitive drum 20 after the transfer is removed by a cleaner 26.

Figures 2, 2A:
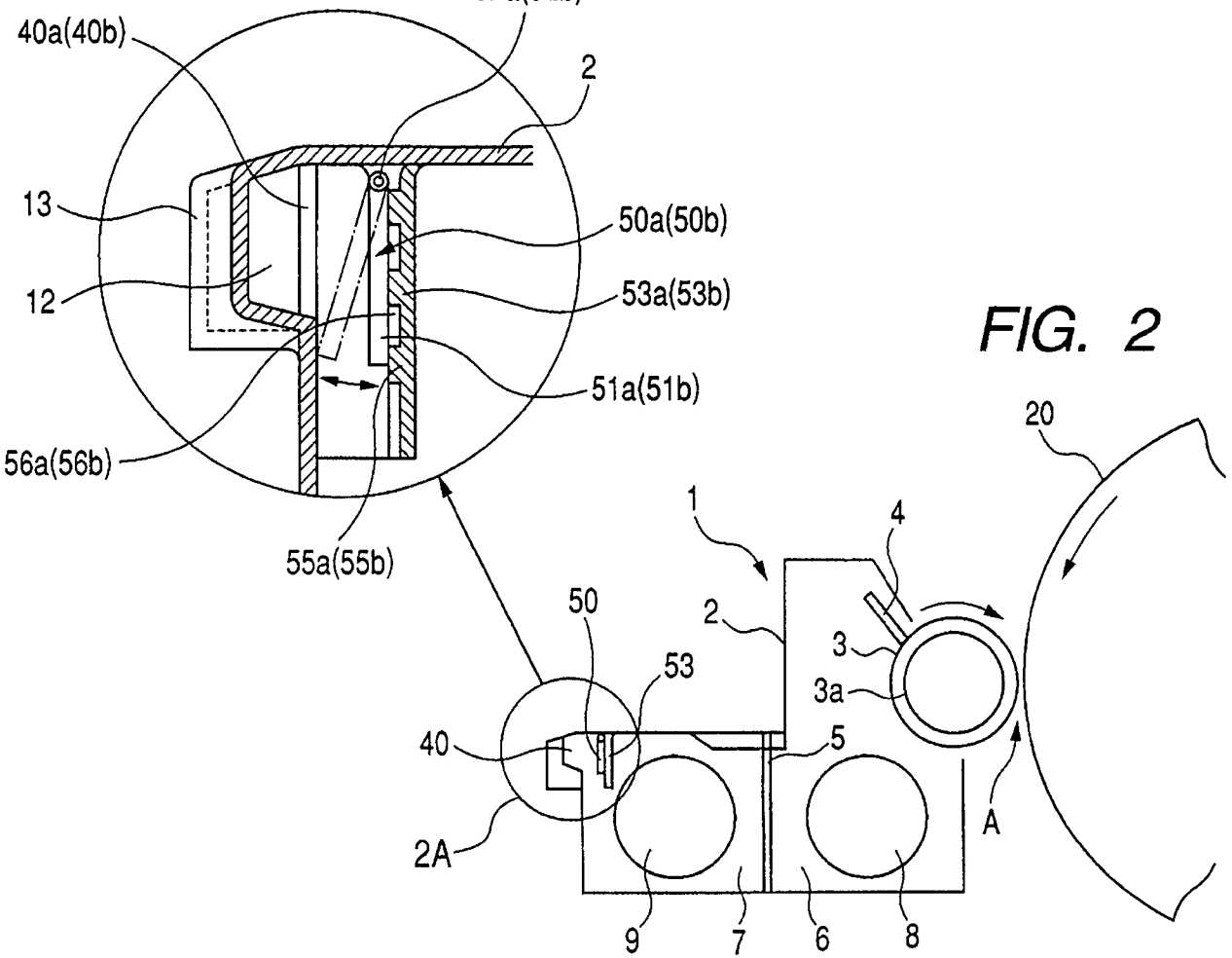
FIG. 2 illustrates the developing apparatus of the present invention.
FIG. 2A is an enlarged view of a portion encircled by a circle 2A in FIG. 2.

Reference is now made to FIG. 2 to describe the developing apparatus 1 in detail.

The developing apparatus 1 has a developer container 2, and in the present embodiment, a dual-component developer containing a nonmagnetic toner and a magnetic carrier is contained therein.

Further, in the developer container 2, a developing sleeve 3 as a developer carrying member is rotatably carried, and the developing sleeve 3 includes therein a stationary magnet 3*a* which is magnetic field generating means. When the developing apparatus 1 has been moved to the developing portion, the developing sleeve 3 forms a developing area A opposed to the photosensitive drum 20.

The developing sleeve 3 is formed of a nonmagnetic material, and is rotated in the direction indicated by the arrow in FIG. 2 during a developing operation, and holds the dual-component developer in the developer container 2 in a layer shape and carries and conveys it to the developing area A. The thickness of the developer layer on the developing sleeve 3 is regulated to a predetermined layer thickness by a regulating blade 4. The developing sleeve 3 supplies the dual-component developer to the developing area A opposed to the photosensitive drum 20, and develops the electrostatic latent image formed on the photosensitive drum 20. The developer after having developed the electrostatic latent image is conveyed in accordance with the rotation of the developing sleeve 3, and is collected in the developer container 2.

A development bias comprising an AC voltage superimposed on a DC voltage is applied from development bias generating means (not shown) to the developing sleeve 3. The waveform of the AC component is a rectangular wave having a frequency of 2 kHz and Vpp of 2 kV. An alternating electric field is formed between the developing sleeve 3 and the photosensitive drum 20 by this development bias, and the toner is electrically peeled off from the carrier to thereby form toner mist, whereby developing efficiency is improved.

The dual-component developer will now be described in detail.

The toner is obtained by kneading a pigment with a resin binder consisting chiefly of polyester, and crushing and classifying the mixture, and further extraneously adding to it a super-fine particle extraneous additive for imparting fluidity, the chargeability of the toner and the stability of the environment. Use is made of a toner having a volume mean particle diameter of the order of 8 μm. As the carrier, use is made of a core consisting chiefly of ferrite, and coated with silicon resin, and having a 50% particle diameter ($D_{50}$) of 40 μm. Such a toner and a carrier are mixed together at a weight ratio of about 8:92, and the mixture is used as a dual-component developer of toner density (TD ratio) 8%.

Further, as the light-colored and dark-colored toners, use was made of toners-having had their number of pigment parts adjusted so that optical density might be 0.8 and 1.6, respectively, per 0.5 mg/cm$^2$ of toner amount on the transfer material.

Specifically, in the present embodiment, the light-colored toners were manufactured with the number of pigment parts of the dark-colored toner set to ⅕.

A description will now be made of main portions, which lead to the arising of problems in the present embodiment.

In the present embodiment, when the toner is consumed by image formation, the corresponding amount of toner is supplied from a developer supplying tank (not shown) via a supplying pipe 12 (see FIG. 1).

Now, as shown in FIG. 2, in the present embodiment, the developer container 2 is comparted into a first chamber 6 which is a developing chamber near the developing sleeve 3 and a second chamber 7 which is an agitating chamber, by a partition wall 5. A first conveying screw 8 which is a first conveying member and a second conveying screw 9 which is a second conveying member are disposed in the first chamber 6 and the second chamber 7, respectively. The developers are circulated in the developer container 2 by the first conveying screw 8 and the second conveying screw 9, and are mixed and agitated. The direction of circulation of the developers, in the present embodiment, as indicated by the arrows in FIG. 3 (a view of the lower portion of the developer container 2), is a direction from the inner part side toward this side in FIG. 2 on the first conveying screw 8 side, and is a direction from this side toward the inner part side in FIG. 2 on the second conveying screw 9 side.

Figure 3:
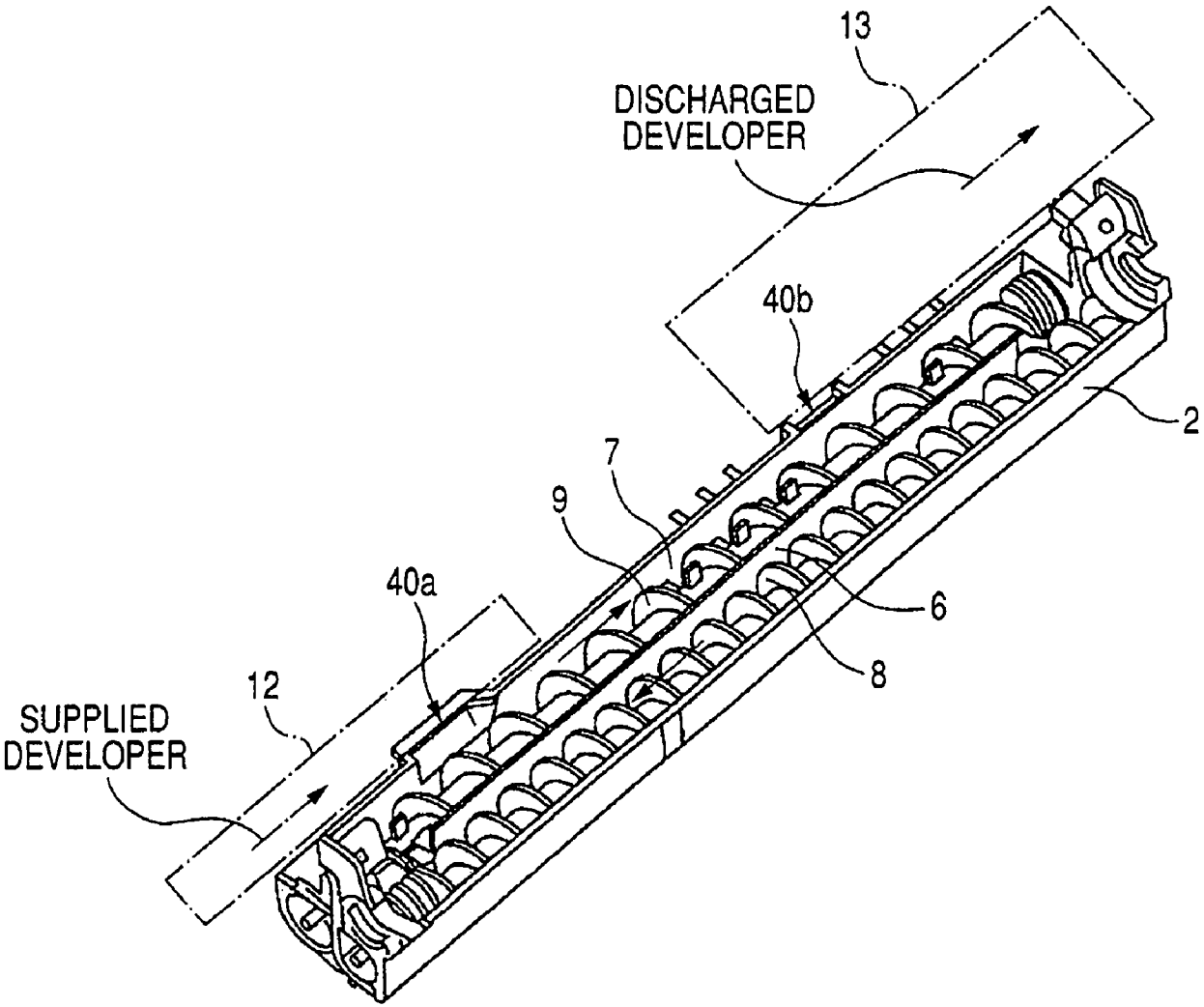
FIG. 3 is a view of the lower portion of the developing apparatus illustrating a supplying port and a discharge port.
Figure 4:
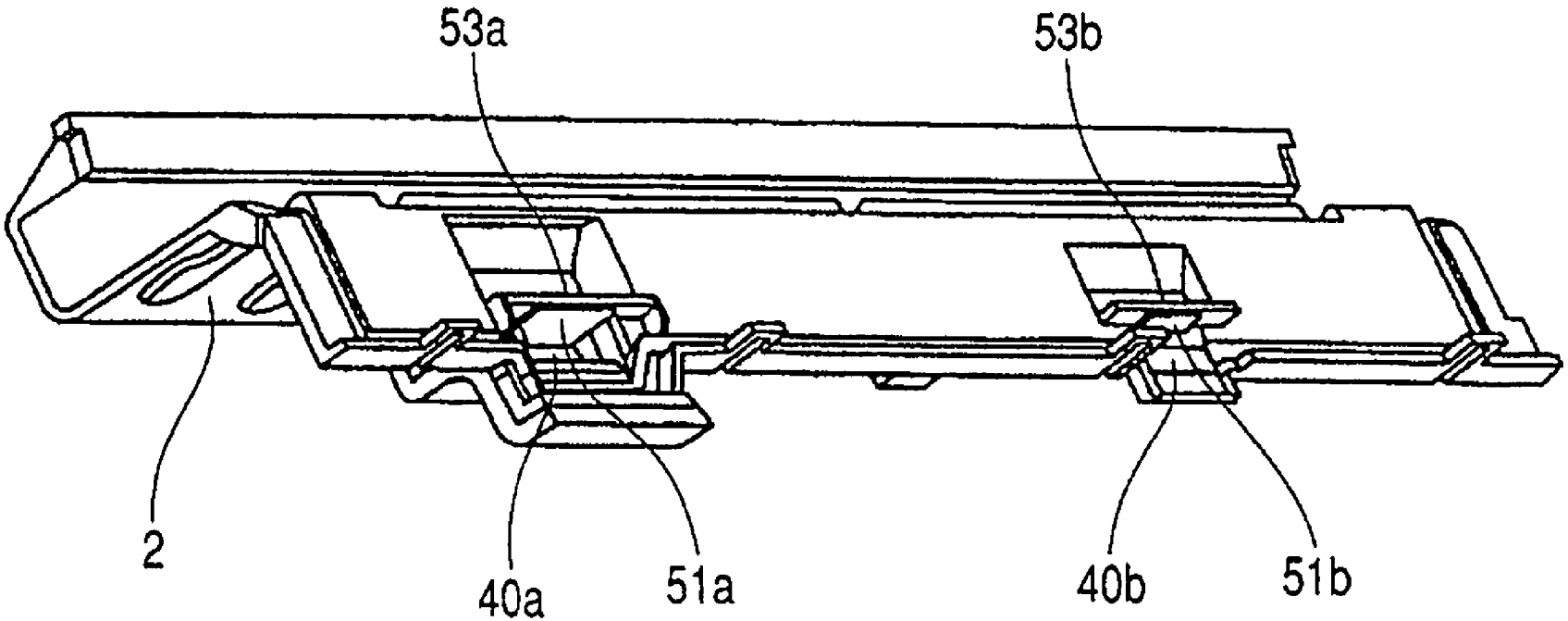
FIG. 4 is a view of the upper portion of the developing apparatus illustrating valves provided in the supplying port and the discharging port.

As will be understood with reference to FIGS. 2 and 3, and further a view of the upper portion of the developer container (i.e., the lid portion of the developer container 2) shown in FIG. 4, in the developing apparatus 1 according to the present embodiment, opening portions 40 are provided in communication with the second chamber 7 which is an agitating chamber, in the developer container 2. The opening portion 40*a* of the developer container 2 is a developer supplying port, and the opening portion 40*b* is a developer discharging port.

Also, valves 50 for opening and closing the opening portions 40 are disposed in the opening portions 40. That is, a valve 50*a* for opening and closing the supplying port 40*a* is disposed in the supplying port 40*a*, and a valve 50*b* for opening and closing the discharging port 40*b* is disposed in the discharging port 40*b*.

The valves 50 (50*a*, 50*b*), as shown in FIG. 2, have valve plates 51 (51*a*, 51*b*) disposed adjacent to the opening portions 40 (40*a*, 40*b*) with a slight distance kept therefrom. These valve plates 51 (51*a*, 51*b*) are swingably mounted on the developer container 2 by pivot shafts 52 (52*a*, 52*b*). The valve plates 51 are designed to hang to the downstream side in the direction of gravitational force (i.e., in a vertical direction) from gravity.

Also, stopper walls 53 (53*a*, 53*b*) for limiting the swinging movement of the valve plates 51 (51*a*, 51*b*) in a direction opposite to the opening portions 40 (40*a*, 40*b*) to thereby restrict the movement ranges of the valves 50 are disposed adjacent to the valve plates 51 (51*a*, 51*b*).

Figure 5:
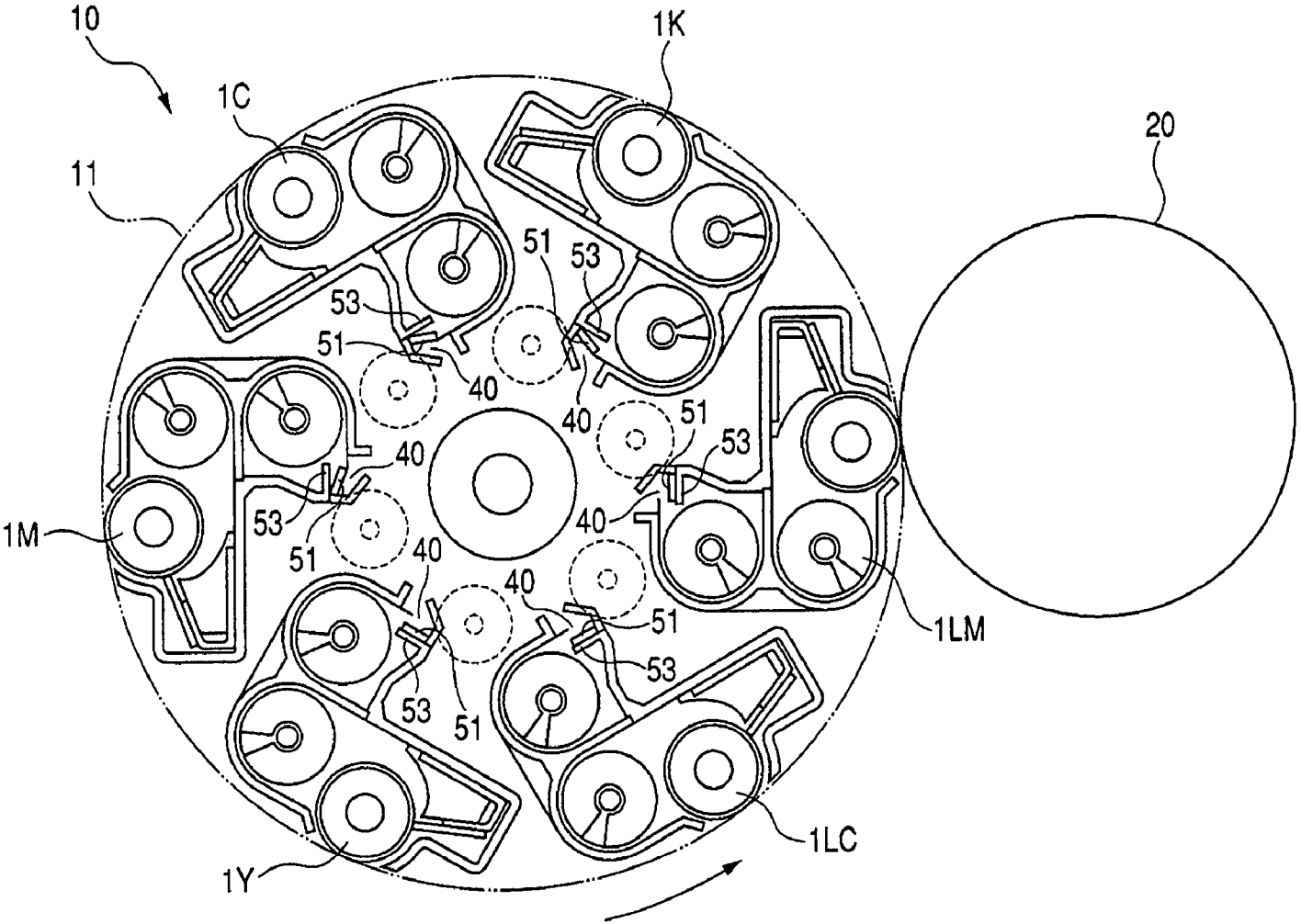
FIG. 5 illustrates the opening and closing operation of the valve in the developing apparatus of the present invention.

Reference is now had to FIGS. 1 and 5 to describe the opening and closing operation of the valves 50 brought about by the rotation of a rotary member, i.e., a developing rotary 11.

When the developing apparatus 1 is moved to the developing portion (in FIGS. 1 and 5, a position at which the developing apparatus 1LM is located), and is maintained in a substantially horizontal position, as shown in FIG. 2, the valves 50 (50*a*, 50*b*), i.e., the valve plates 51 (51*a*, 51*b*) hang in a substantially vertical state from gravity. Accordingly, valve plates 51 (51*a*, 51*b*) maintain the opening portions 40 (40*a*, 40*b*) in their opened states to thereby make the supply of the supplied developer to the developer container 2 and the discharge of the developer from the developer container 2 possible. On the other hand, as the rotary member, i.e., the developing rotary 11 is rotated and the developing apparatus 1 is moved from the developing portion in the direction indicated by the arrow in FIG. 1, the opening portions 40 (40*a*, 40*b*) are closed by the valve plates 51 (51*a*, 51*b*). Accordingly, when the developing apparatus 1 has been moved to the position of the developing apparatuses 1K and 1C in FIGS. 1 and 5, the opening portions 40 (40*a*, 40*b*) become closed by the valve plates 51 (51*a*, 51*b*). Furthermore, as the developing apparatus 1 is moved from the position of the developing apparatus 1M in the direction indicated by the arrow in FIG. 1, the valve plates 51 (51*a*, 51*b*) are moved away from the opening portions 40 (40*a*, 40*b*) from gravity. The valve plates 51 (51*a*, 51*b*) come into contact with the stopper walls 53 (53*a*, 53*b*), whereby any further swinging movement thereof is hampered, and the opening portions 40 (40*a*, 40*b*) become opened.

Here, the mixing ratio of the toner and carrier in this supplied developer is of the order of 7:1 in terms of weight ratio, but is not particularly restricted to this numerical valve. That is, the toner amount is overwhelmingly great relative to the ratio of the dual-component developer in the developer container 2, and if the volume ratio is considered, it can also be considered that a slight amount of carrier is mixed with the toner. That is, when the toner consumed by image formation is to be replenished, a slight amount of carrier is gradually supplied. In some cases, the supplied developer is the carrier only, or the toner only.

If the ratio of the carrier in the supplied developer becomes great, the amount of replacement of the carrier will become great for the same amount of toner supply, and the dual-component developer in the developing apparatus 1 will approximate to a fresh state, but correspondingly, the amount of consumption of the carrier will become great. Therefore, it is preferable that in the respective apparatuses, a suitable mixing ratio be discretely determined.

When the consumption of the toner by image formation and the supply of the toner by toner supply amount controlling means are repeated, the carrier supplied together during the supply of the toner is increased in the developer container 2. The toner density in the dual-component developer is kept substantially constant by the toner supply amount controlling means and thus, the developer amount in the developer container 2 is increased. Of the dual-component developer which has become excessive, an amount having passed through the opening portion of the developer discharging port 40*b* shown in the view of the lower portion of the developer container 2 shown in FIG. 3 is collected in a collecting pipe 13.

Here, the developer supplying port 40*a* and discharging port 40*b* of the developer container 2 are located at the most remote locations in the second chamber 7 which is the agitating chamber, that is, the supplying port 40*a* is located upstream with respect to the flow of the developer, and the discharging port 40*b* is located downstream with respect to the flow of the developer. Accordingly, the fresh carrier supplied from the developer supplying port 40*a* is contained in the developer container 2, and is mixed and agitated with the dual-component developer circulated to the agitating chamber 7, at least in the agitating chamber 7. Also, most of the developer discharged from the developer discharging port 40*b* and collected in the collecting pipe 13 is the used, namely, deteriorated developer which has been used for repeated image formations in the developing apparatus 1. In this manner, the replacement of the dual-component developer is gradually effected.

In a system wherein as in the present embodiment, the developing apparatus 1 is disposed in the rotatably carried developing rotary 11, i.e., a system in which the developing apparatus itself is moved, there is the possibility of the developer inadvertently leaking out from the supplying port or the discharging port, except in the substantially horizontal position of the developing apparatus in which the developing apparatus 1 is opposed to the photosensitive drum 20. In such a case, the developer in the developing apparatus is greatly diminished with a result that the uniformity of the developer coat on the developer carrying member is spoiled or the developer does not coat at all, and this leads to the faulty uniformity of the density in the surface or the occurrence of the inconvenience that density is not provided at all.

Accordingly, in the present embodiment, as described above, the valves 50 (50*a*, 50*b*) are provided in the supplying port 40*a* and the discharging port 40*b*. Except in the substantially horizontal position of the developing apparatus, the developer is prevented from inadvertently leaking out from the supplying port 40*a* or the discharging port 40*b* and yet, the supply or the discharge is controlled.

However, the valves 50 (50*a*, 50*b*), i.e., the valve plates 51 (51*a*, 51*b*) are at locations liable to be contaminated with the developer and therefore, the operation thereof has often become unstable. Particularly, in a low-humidity environment, the charging amount of the toner per unit mass increases and therefore, it becomes difficult to remove the toner adhering to the wall surfaces of the stopper walls 53 (53*a*, 53*b*) for restricting the operation range of the valve plates 51 (51*a*, 51*b*) and the valve plates 51 (51*a*, 51*b*) by the Coulomb force. In a state in which the toner is sandwiched between the stopper walls 53 (53*a*, 53*b*) and the valve plates 51 (51*a*, 51*b*) for a long period, there is the possibility that the two valve plates and the stopper wall will adhere in the fashion of a binder to thereby hamper the function of the valves 50.

Figure 6A:
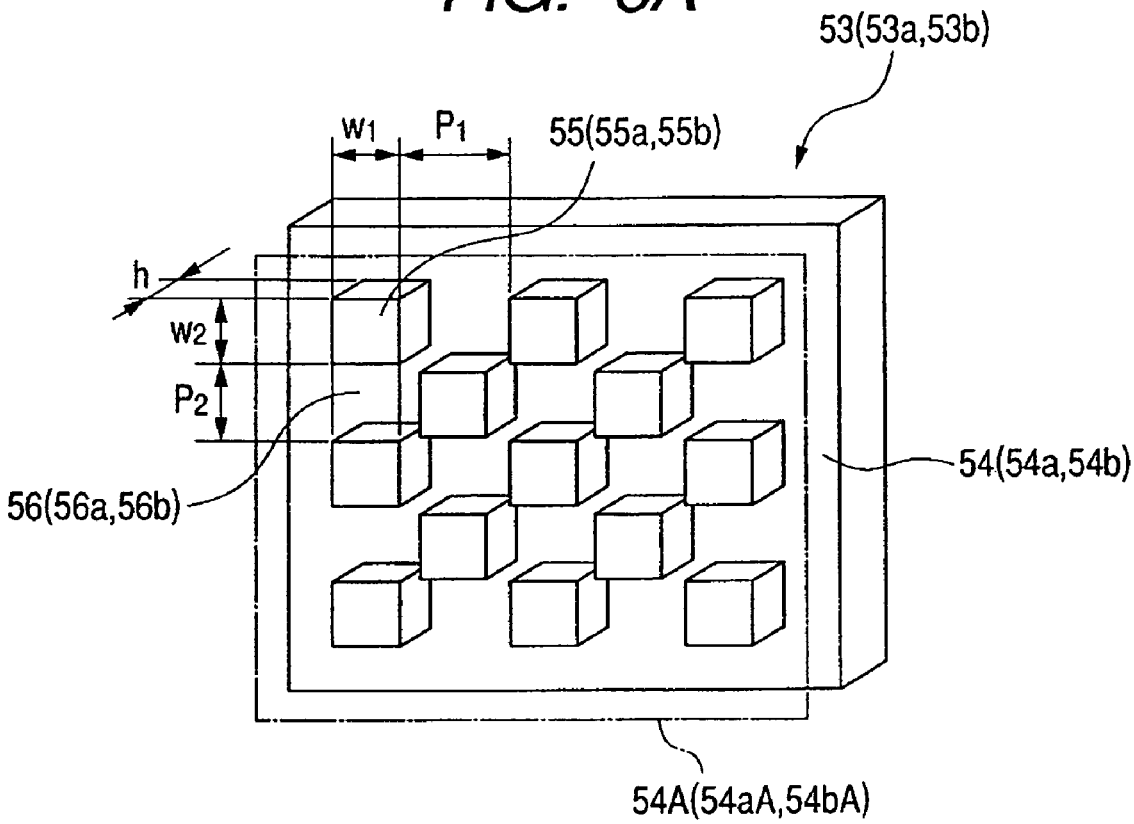
FIGS. 6A and 6B illustrate an embodiment of an irregularity surface formed on a stopper wall surface in accordance with the present invention.
Figure 6B:
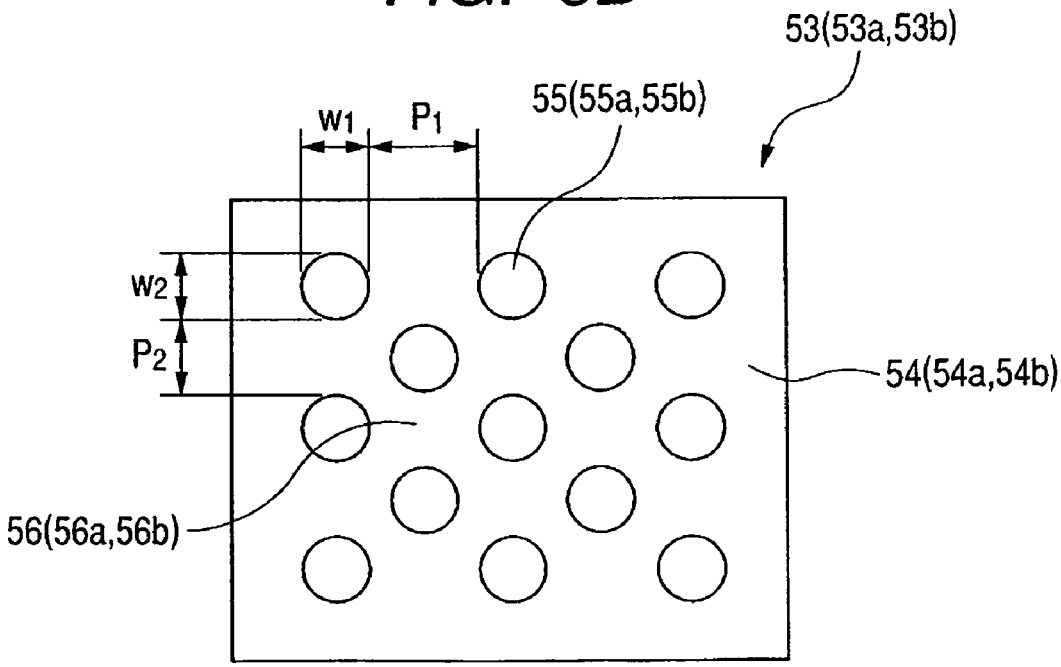

So, as shown in FIGS. 6A and 6B, in the present embodiment, the wall surfaces 54 (54*a*, 54*b*) of the stopper walls 53 (53*a*, 53*b*) with which the valve plates 51 (51*a*, 51*b*) contact are made into an irregular shape. Thereby, the contact area between the two was decreased to thereby reduce the effect of the developer working as a binder, whereby an attempt was made to secure function of the valves.

In the present embodiment shown in FIGS. 6A and 6B, the wall surfaces of the stopper walls 53 (53*a*, 53*b*) are made into irregularity surfaces by protrusions 55 and recesses 56 being alternately formed in lengthwise and widthwise directions (orthogonal directions). While in the present embodiment, the shape of the protrusions 55 (55*a*, 55*b*) is a quadrangular prism shape having a minor axis, as shown in FIG. 6A this is not restrictive, but other polygonal shapes may also be adopted. Also, as shown in FIG. 6B, a columnar shape (w1=w2) is possible, and a prism of other oblong shape or elliptic shape (w1≠w2) or the like other than a circular cross section can also be adopted.

Also, in the present embodiment shown in FIGS. 6A and 6B, the protrusions 55 are disposed in spaced-apart relationship with one another, that is, the recesses 56 communicate with one another, but the protrusions 55 can also be connected together.

The protrusions 55 need not be uniformly distributed on the entire surface, but may also be non-uniformly disposed within the range of dimensions and shape shown below.

The specific shape and dimensions of the protrusions 55 (55*a*, 55*b*) in the present embodiment shown in FIGS. 6A and 6B are as follows.

When for example, the protrusions are of a quadrangular prism shape as shown in FIG. 6A, it is preferable that the height of the protrusions 55 (i.e., the depth of the recesses 56) (h), the lengthwise and breadthwise widths (w1 and w2) of the protrusions 55, and the intervals (P1 and P2) between adjacent protrusions 55 be 0.5 mm-5 mm. The reason for this will be set forth below.

The carrier and toner in the developer are generally in a state in which the toner forms a single-layer coat around the carrier. The particle diameter in this state is 30 μm-100 μm when an ordinary carrier and an ordinary toner are used.

In the present embodiment, a carrier of 35 μm and a toner of 6 μm are used and therefore, the particle diameter of the compound of the carrier and toner is 47 μm. Accordingly, if the depth (corresponding to the height (h) of the protrusions 55) and the width (corresponding to the intervals P1 and P2 between adjacent protrusions) of the recesses 56 are 500 μm (0.5 mm), the compound of the carrier and toner can completely enter the recesses 56. Also, by making the surfaces 54 of the stopper walls 53 into irregular surfaces, it is possible to decrease the contact area between the valves 51 and the stopper walls 53. When conversely, the depth (h) and width (P1 and P2) of the recesses 56 are 50 μm or less, the probability with which the compound of the carrier and toner is inserted into the recesses increases and therefore, the effect of the reducing the contact area by the irregularity surfaces becomes unobtainable.

Also, if the depth (h) and width (P1 and P2) of the recesses 56 are 5 mm or greater, the probability with which the secondary condensate of the compound of the carrier and toner (a condensate in which about 100 compounds of the carrier and toner have gathered) easily enters the recesses 56 will increase. Consequently, it is preferable that the depth (h) and width (P1 and P2) of the recesses 56 be 5 mm or less.

Also, the places made into the irregularity surfaces are not restricted to the wall surfaces 54 of the stopper walls 53 which are opposed to the valves 50, but may be the surfaces of the valve plates 51 which are opposed to the stopper walls 53. As required, the irregularity surfaces may be provided only on the valve plates 51.

Table 1 below shows the result of the confirmation of the presence or absence of valve clogging when irregularities were provided on the stopper wall surfaces 54 and the contact area between the two was decreased while the environment (temperature/humidity) around the image forming apparatus was changed.

In the present embodiment, the contact area is defined as follows.

Figure 7:
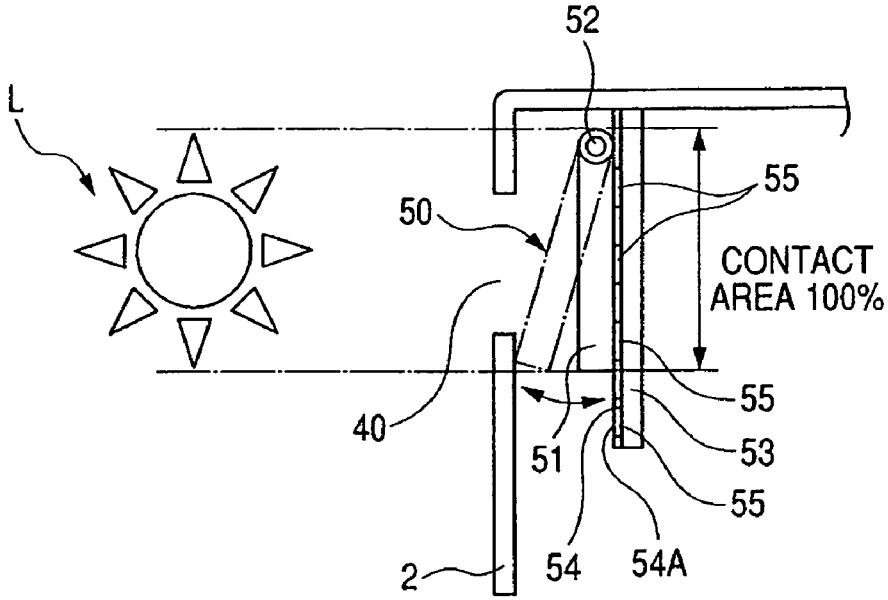
FIG. 7 illustrates the definition of a contact area ratio.

In a state as shown in FIG. 7 wherein the valve 50 and the stopper wall 53 are in contact with each other, a light source L is disposed as shown in FIG. 7, that is, on a side on which the valve 50 is present with respect to the surface of the stopper wall 53. The area in which the valve 50 is projected onto the planar surface (when irregularities are present on the stopper wall 53, the planar surface linking the vertexes of the protrusions 55 together) 54A (see also FIG. 6) of the stopper wall 53 is defined as the contact area (contact area 100%) when there are no irregularities on two surfaces on which the valve 50 and the stopper wall 53 are opposed to each other.

In the present embodiment, the stopper wall 53 is made into an irregularity surface, whereby the degree of reduction in the contact area between the valve 50 and the stopper wall surface 54A is expressed as a contact area ratio by percentage.

The adjustment of the contact area was effected by changing the number of the protrusions 55, that is, changing the width (P1 and P2) of the recesses 56. Also, in the present investigation, the irregularities pattern is shown as what is shown in FIG. 6A, and the dimensions thereof were within the above-mentioned range of dimensions. The present investigation was confirmed by an endurance test of 1 k sheets of A4 size paper. The environments mentioned in Table 1 below are such that 25° C./5% represents a low-humidity environment, 25° C./50% represents an ordinary environment, and 30° C./80% represents a high-temperature and high-humidity environment.

TABLE 1

Example 1 of Irregularities

| Contact area ratio | | 100% | 80% | 60% | 50% | 40% | 30% |
|---|---|---|---|---|---|---|---|
| Environment (temperature/ humidity) | 25° C./5% | x | x | ○ | ○ | ○ | ○ |
| | 25° C./50% | x | ○ | ○ | ○ | ○ | ○ |
| | 30° C./80% | ○ | ○ | ○ | ○ | ○ | ○ |

○: Valve clogging does not occur.
x: Valve clogging occurs.

from this result, it will be seen that the environment which is liable to cause valve clogging is a low-temperature environment of temperature: 25° C. and humidity: 5%. This is attributable to the fact that under a low-humidity environment, the change amount of the toner per unit mass increases. Under the low-humidity environment, it becomes difficult to remove the toner adhering to the stopper walls 53 which prescribe the operation range of the valves 50 and to the valves 50 by a Coulomb force. Therefore, in a state in which the toner are sandwiched between the stopper walls 53 and the valves 50 for a long period, it tightens the two in the fashion of a binder to thereby hamper the function of the valves 50.

However, it could be confirmed that even under the low-humidity environment (25° C./5%) which is liable to cause valve clogging, if the contact area ratio is 60% or less, the action of the toner tightening the valves 50 and the walls 53 in the fashion of a binder can be avoided and therefore the valve clogging can be prevented.

From the result shown above, the valve clogging can be sufficiently prevented even under a low-humidity environment of humidity of the order of 5% if a construction in which the contact area ratio is 50% or less is adopted. Accordingly, even a super-low humidity environment of humidity less than 5% can be coped with to a certain degree and therefore, in the present embodiment, an irregular surface was provided so that the contact area ratio might be 50%.

Synthesizing what is shown by the result of the above-described investigation, the valve clogging will not be caused if the contact area ratio is suppressed to 50% or less, irrespective of the environment under which the image forming apparatus is placed (particularly even in the case of low-humidity). Consequently, the developer supplying and discharging properties can be maintained while the unnecessary leakage of the developer due to the movement of the developing apparatus is prevented, and the object of the present invention can be achieved.

Second Embodiment

In this embodiment, the basic construction of a developing apparatus is made similar to that of the first embodiment, and is a construction in which an improvement in the enduring ability of an image forming apparatus is taken into consideration. Accordingly, regarding the constructions of the developing apparatus and the image forming apparatus, the description of first embodiment is invoked and a redundant description will be omitted.

In the first embodiment, when the irregularity portion (the protrusions 55 and the groove portions 56) provided on the surfaces 54 of the stopper walls 53 are clogged with the developer or the toner, there is the possibility that the clogging may not be eliminated.

In the first place, in the developing apparatus 1 of the construction of the first embodiment, the stopper wall surfaces 54A prevent the extreme inflow of the developer into between the valves 50 and the stopper wall surface 54. Consequently, in the endurance of about 1k sheets, there did not occur a situation in which the groove portions 56 are clogged with the developer or the toner and the clogging cannot be eliminated, and valve clogging also did not occur.

In the investigation of endurance greater than that, the probability with which the extraneous additive in the toner in the developer slips out becomes high, and the fluidity of the developer is aggravated. As the result, the recesses 56 in the irregularity portions provided on the stopper wall surfaces 54 become liable to be clogged with the developer or the toner, and there was the possibility of valve clogging occurring.

So, in the present embodiment, there has been considered a construction in which even if the recesses 56 are about to be clogged with the developer by endurance, the developer can slip out easily.

The construction of the developing device shown in the present second embodiment, as described above, is substantially the same as that in the first embodiment. However, as shown in FIG. 8, there is adopted a construction in which protrusions 55 (55*a*, 55*b*), i.e., recesses 56 (56*a*, 56*b*) range on the stopper wall surfaces 54 (54*a*, 54*b*) at predetermined intervals on the downstream side with respect to the direction of gravitational force.

Figure 8:
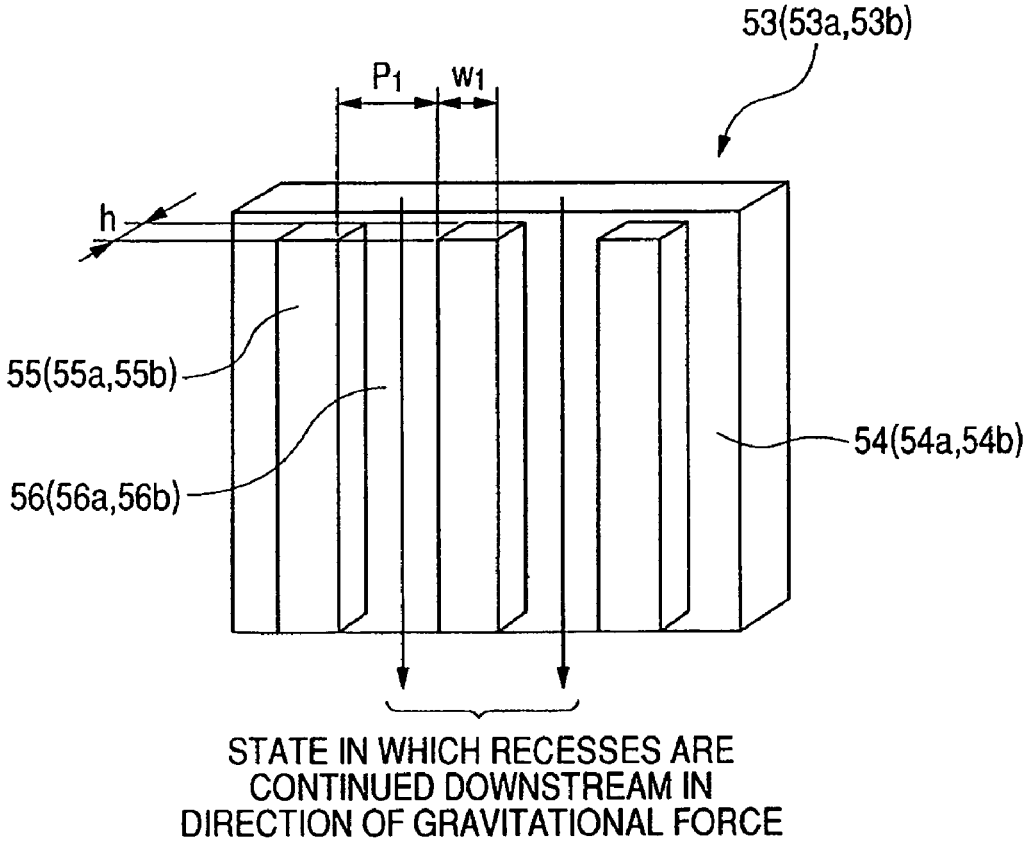
FIG. 8 illustrates another embodiment of the irregularity surface formed on the stopper wall surface in accordance with the present invention.

The specific shapes and dimensions of the protrusions 55 (55*a*, 55*b*) and recesses 56 (56*a*, 56*b*) in the present embodiment shown in FIG. 8 are shown as follows.

For example, it is preferable that the height (h) of the protrusions 55 (55*a*, 55*b*) (i.e., the depth of the recesses 56 (56*a*, 56*b*)), the width (w1) of the protrusions 55 (55*a*, 55*b*) and the interval P1 between adjacent protrusions 55 (corresponding to the width of the recesses 56 (56*a*, 56*b*)) be 0.5 mm-5 mm. The reason will be set forth below. The width (w1) of the protrusions 55 (55*a*, 55*b*) or the width (P1) of the recesses 56 (56*a*, 56*b*) need not be the same over the entire surface, but may differ within the above-mentioned range.

Table 2 below shows the result of the confirmation of the valve clogged state effected by an endurance test of 500 k sheets of A4 size paper with the contact area ratio by the irregularities provided on the stopper wall surfaces 54 fixed at 50%. The environment verified in Table 2 is a low-humidity environment of 25° C./5%, and is an environment under which valve clogging is liable to occur as proved by the investigation of the first embodiment.

Table 2 shows the result of the comparative investigation of the pattern of irregularities carried out under the above-mentioned condition with respect to Example 1 of Irregularities of the first embodiment shown in FIG. 6A, and Example 2 of Irregularities of the second embodiment shown in FIG. 8. The irregularity portion is of the dimensions within the above-mentioned range, and the contact area ratio is 50%.

TABLE 2

| | | Example 2 of Irregularities | | | | | |
|---|---|---|---|---|---|---|---|
| Number of endurance sheets (sheets) | | 1k | 10k | 50k | 100k | 200k | 500k |
| example of irregularities | 1 | ○ | ○ | x | x | x | x |
| | 2 | ○ | ○ | ○ | ○ | ○ | ○ |

From Table 2 above, it could be confirmed that valve portion clogging does not occur in the developing apparatus according to the present embodiment adopting a construction in which the recesses of the irregularity portions provided on the stopper wall surfaces range on the downstream side with respect to the direction of gravitational force.

This is because if the groove portions range downstream with respect to the direction of gravitational force, even if the developer or the toner is about to be jammed, the developer or the toner being about to be jammed is discharged out of the grooves by the action of the gravitational force when the developing apparatus is in a substantially horizontal state which is a position opposed to the drum (developing position).

Synthesizing what is shown by the result of the above-described investigation, as shown in the first embodiment, even in a case where the environment under which the image forming apparatus is placed is at low humidity liable to cause valve clogging, if the contact area ratio of the valve 50 and the stopper wall 53 is suppressed to 50% or less, valve clogging will not be caused at the initial stage of endurance. Therefore, it is possible to prevent the unnecessary leakage of the developer due to the movement of the developing apparatus and yet, maintain the developer supplying and discharging properties, and the object of the present invention can be achieved.

During long-term endurance, however, the fluidity of the developer is aggravated and therefore, if no contrivance is made about the irregularity surface, the recesses are clogged with the developer or the toner and the effect of reducing the contact area becomes null and thus, it has been difficult to avoid valve clogging.

So, in the present embodiment, there is adopted the construction in which the recesses (groove portions) of the irregularity portion range downstream with respect to the direction of gravitational force, whereby the developer or the toner being about to be jammed is discharged out of the grooves by the action of the gravitational force and therefore, even when the fluidity of the developer has become bad, valve clogging can be avoided and the objects of the invention can be achieved.

In each of the above-described embodiments, the developing apparatus of the present invention has been described as having a developer supplying port and a discharging port as an opening portion. However, the present invention is not restricted to such construction, but the above-described construction can also be applied to a developing apparatus provided with only a supplying port or only a discharging port, to thereby achieve a similar operational effect.

Also, in the foregoing embodiments, a description has been made of an image forming apparatus of an intermediate transfer type using the intermediate transfer belt 24. The image forming apparatus of the present invention, however, can be an image forming apparatus of a conveying belt type well known to those skilled in the art which is provided with a conveying belt for bearing and conveying recording paper P thereon, instead of the intermediate transfer belt 24, and in which toner images of respective colors are superposed on this recording paper P.

This application claims priority from Japanese Patent Application No. 2005-261393 filed on Sep. 8, 2005, which is hereby incorporated by reference herein.

What is claimed is:

1. A developing apparatus for developing an electrostatic image on an image bearing member at a developing position, said developing apparatus comprising:

a developer container, which contains a developer including a toner and a carrier;

a rotary member, which holds said developer container, and rotatively moves said developer container relative to said developing position;

an opening portion provided in said developer container and through which the developer is supplied or discharged;

a valve swingable to open and close said opening portion, said valve being located at an opened position when said developer container is at said developing position;

a restricting wall, which restricts a movement of said valve in an opening direction of said valve by contacting with said valve when said valve is in said opened position; and an irregularity portion formed on at least one of a contact surface of said valve with said restricting wall, and a contact surface of said restricting wall with said valve, wherein each of a height of said irregularity portion and a width of said irregularity portion is larger than a sum of a diameter of said carrier and a double diameter of said toner.

2. A developing apparatus according to claim 1, wherein said irregularity portion includes recesses and protrusions, and wherein a rate of said recesses of said irregularity portion is larger than a rate of said protrusions of said irregularity portion in an area in which said valve and said restricting wall are opposite to each other in a state in which said valve and said restricting wall contact with each other.

3. A developing apparatus according to claim 1, wherein the height of said irregularity portion is 0.5 mm or greater and 5.0 mm or less.

4. A developing apparatus according to claim 1, wherein the width of said irregularity portion is 0.5 mm or greater and 5.0 mm or less.

5. A developing apparatus according to claim 1, wherein said irregularity portion is such that on said at least one, recesses and protrusions are alternately formed in two directions orthogonal to each other.

6. A developing apparatus according to claim 1, wherein said irregularity portion is formed so that on said at least one, recesses and protrusions continuously formed along a direction of gravitational force may be alternately provided in a direction orthogonal to said direction of gravitational force.

7. A developing apparatus according to claim 1, wherein said developer includes a nonmagnetic toner and a magnetic carrier.

8. A developing apparatus according to claim 1, wherein said valve is designed to be swingable with an aid of gravitational force with a rotating operation of said rotary member.

* * * * *